US008051511B2

(12) United States Patent
Nahavandi et al.

(10) Patent No.: US 8,051,511 B2
(45) Date of Patent: Nov. 8, 2011

(54) EMERGENCY STRETCHER

(75) Inventors: Kurosh Nahavandi, Portage, MI (US); Steve Knipfel, Portage, MI (US); Cliff Lambarth, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 519 days.

(21) Appl. No.: 12/251,141

(22) Filed: Oct. 14, 2008

(65) Prior Publication Data

US 2009/0178198 A1 Jul. 16, 2009

Related U.S. Application Data

(60) Provisional application No. 61/020,884, filed on Jan. 14, 2008.

(51) Int. Cl.

| | |
|---|---|
| ***A61G 1/00*** | (2006.01) |
| ***A61G 1/06*** | (2006.01) |
| ***A61G 7/012*** | (2006.01) |

(52) U.S. Cl. ..... 5/611; 5/86.1; 296/20

(58) Field of Classification Search ..... 5/11, 611, 5/86.1; 296/20

See application file for complete search history.

(56) References Cited

U.S. PATENT DOCUMENTS

| | | | | |
|---|---|---|---|---|
| 2,958,873 | A * | 11/1960 | Ferneau | 5/86.1 |
| 4,097,941 | A | 7/1978 | Merkel | |
| 4,767,148 | A | 8/1988 | Ferneau et al. | |
| 5,509,159 | A | 4/1996 | Du-Bois | |
| 5,537,700 | A | 7/1996 | Way et al. | |
| 5,575,026 | A | 11/1996 | Way et al. | |
| 5,594,961 | A * | 1/1997 | Yokoi et al. | 5/11 |
| 6,219,864 | B1 * | 4/2001 | Ellis et al. | 5/600 |
| 6,276,010 | B1 * | 8/2001 | Way et al. | 5/611 |
| 6,389,623 | B1 | 5/2002 | Flynn et al. | |
| 6,526,611 | B2 | 3/2003 | Flynn et al. | |
| 6,701,545 | B1 | 3/2004 | Ferneau et al. | |
| 7,100,224 | B2 | 9/2006 | Knipfel | |
| 7,389,552 | B1 | 6/2008 | Reed et al. | |
| 7,540,547 | B2 * | 6/2009 | Lambarth et al. | 296/20 |
| 7,549,690 | B2 * | 6/2009 | Bourgraf et al. | 296/20 |
| 7,694,368 | B2 * | 4/2010 | Lewis, Jr. | 5/611 |
| 2005/0241063 | A1 | 11/2005 | Ferneau et al. | |
| 2006/0075558 | A1 | 4/2006 | Lambarth et al. | |
| 2007/0056115 | A1 | 3/2007 | Flick | |

FOREIGN PATENT DOCUMENTS

WO WO 2007/069066 6/2007

* cited by examiner

*Primary Examiner* — Michael Trettel
(74) *Attorney, Agent, or Firm* — Warner Norcross & Judd LLP

(57) ABSTRACT

A stretcher includes a patient support, a base, and a plurality of support members, which supports the patient support relative to the base. The support members are adapted and arranged to raise or lower the base relative to the patient support. The stretcher also includes a releasable locking link between the patient support and a fixable point at the base.

21 Claims, 13 Drawing Sheets

EMERGENCY STRETCHER

This application claims the benefit of provisional patent application entitled EMERGENCY STRETCHER, Ser. No. 61/020,884, filed Jan. 14, 2008, which is hereby incorporated by reference in its entirety herein.

TECHNICAL FIELD AND BACKGROUND OF THE INVENTION

The present invention relates to an emergency stretcher or cot and, more particularly, to an emergency stretcher that eliminates "base sag" and remains in its compact, folded configuration, which results in the cot being easier to load or unload from an emergency transport vehicle.

When a stretcher is unloaded, for example from an ambulance, it is often desirable to allow the base of the stretcher to be quickly released and lowered from its compact configuration in the ambulance to a ground engaging position spaced further from the patient support or litter of the stretcher. This release is referred to as a "hot-drop" function, which allows a single emergency medical technician (EMT) to remove a stretcher out of the back of an ambulance without the need for a second EMT or helper to hold or assist the base being moved down to the ground. To configure the cot so that the base can quickly drop, cots incorporate the use of extendible or collapsible support legs. Because of the collapsible nature of the support legs, when the stretcher is in its folded, compact configuration there may be wobble or end-to-end movement that is inherent from the telescoping legs and their respective joints, which can make loading the cot into the patient compartment of the emergency vehicle more difficult.

Accordingly, there is a need for a stretcher with increased stiffness when the stretcher is in its extended, or raised, configuration to reduce the side-to-side tilting of the litter surface that may occur on prior ambulance stretchers.

SUMMARY OF THE INVENTION

Accordingly, the emergency stretcher of the present invention includes a support frame with the handling capability of prior support frames, but with increased stiffness in the raised position to reduce wobbling or play of the litter surface that may occur on prior ambulance stretchers. Further, when it its compact, folded configuration, the patient support is locked relative to the base, which eliminates "base sag", which can facilitate loading of the cot into the patient compartment of an emergency vehicle. Further, the cot may incorporate a dampening system to reduce the impact forces on the stretcher components when the base is released and dropped relative to the patient support or raised quickly relative to the patient support. Additionally, the cot may incorporate an adjustable load height feature.

In one form of the invention, a stretcher includes a patient support, a base, a plurality of support members supporting the patient support relative to the base, which are adapted and arranged to raise or lower the base relative to the patient support, and a lockable link. Further, the lockable link is provided between the patient support and a point at or near the base when the base is raised to the patient support to thereby eliminate the base sagging or dropping relative to the patient stretcher, for example when the stretcher is being loaded into or unloaded from a transport vehicle. Further, the coupling of the litter to the base improves the retention of the stretcher in the event of a crash by providing restraints in all directions so that the cot does not have a tendency to "accordion" open.

In one aspect, the lockable link comprises a pivotal locking member, for example a pivotal hook, which forms the lockable link.

In further aspects, the stretcher includes an engagement surface at the base, and the pivotal locking member engages the engagement surface to thereby lock the patient support at the base. For example, the engagement surface may be formed by a recess, such as in a loop member, wherein the pivotal locking member is extendable into the recess and engageable with the loop member to thereby lock the patient support at the base.

In addition, the stretcher may include a biasing member, such as a spring, to urge the pivotal locking member into engagement with the engagement surface when the base is raised relative to the patient support.

In yet another aspect, the support members have movable pivot connections at the patient support and pivot connections at the base. Further, the stretcher includes a locking mechanism that releasably locks the longitudinal positions of the movable pivot connections of the support members relative to the patient support to thereby fix the height of the patient support relative to the base.

According to further aspects, the locking member includes a pair of elongate members pivotally mounted at one end to the patient support and movable at their opposed ends between a first position wherein the elongate members lock the longitudinal positions of the movable pivot connections of the support members and a second position wherein the movable pivot connections of the support members are released from their locked positions. In addition, the locking link is coupled to one of the elongate members, which may then be used to move the locking link from its locked position to its unlocked position.

In another form of the invention, a stretcher includes a patient support, a base, and a plurality of support members supporting the patient support relative to the base. Each of the support members comprises a variable length support member and is adapted and arranged to raise or lower the base or the patient support relative to the other. The stretcher also includes a locking mechanism for locking the length of the support members to thereby lock the height of the patient support relative to the base and releasing the support members so that their lengths may be varied wherein the patient support may be moved relative to the base. In addition, a lockable mechanical link is provided for selectively locking the patient support at the base when the base is raised to the patient support or when the patient support is lowered to the base and is movable from its locked position to its unlocked position in response to the locking mechanism releasing the support members.

In one aspect, the lockable link comprises a pivotal hook supported by the patient support and movable between its unlocked position and locked position.

In a further aspect, the stretcher includes a loop at the base with a transverse recess, with the hook extendable into the transverse recess and engageable with the loop when the pivotal hook is moved to its locked position.

In a further aspect, the locking mechanism includes a pair of elongate members movable between a first position wherein the elongate members lock the length of the support members and a second position wherein the support members are released to lower or raise the base relative to the patient support, with the lockable link coupled to one of the elongate members.

In yet another form of the invention, a method of enhancing the stiffness of a stretcher when the stretcher is collapsed into a folded configuration includes mechanically linking the patient support to a point within the base of the stretcher when the base is raised relative to the patient support and the stretcher is in its folded configuration, which prevents the base from sagging or lowering relative to the patient support.

In one aspect, the mechanical linking is automatic when the base is raised adjacent the patient support.

In yet a further aspect, the height of the patient support relative to the base is adjusted and then fixed by a locking mechanism. In addition, the mechanical linking is coupled to the locking mechanism such that the mechanical linking is automatic upon raising the base relative to the patient support or lowering the patient support relative to the base, and the mechanical linking is automatically released when the locking mechanism is actuated to release and allow the base to be lowered relative to the patient support or to allow the patient support to be raised relative to the base.

Accordingly, the present invention provides a stretcher that reduces, if not, eliminates base sag and may include an option which incorporates improved dampening features, stiffness features, and/or adjustable load height features.

These and other objects, advantages, purposes and features of the invention will become more apparent from the study of the following description taken in conjunction with the drawings.

DETAILED DESCRIPTION OF THE INVENTION

Figure 1:
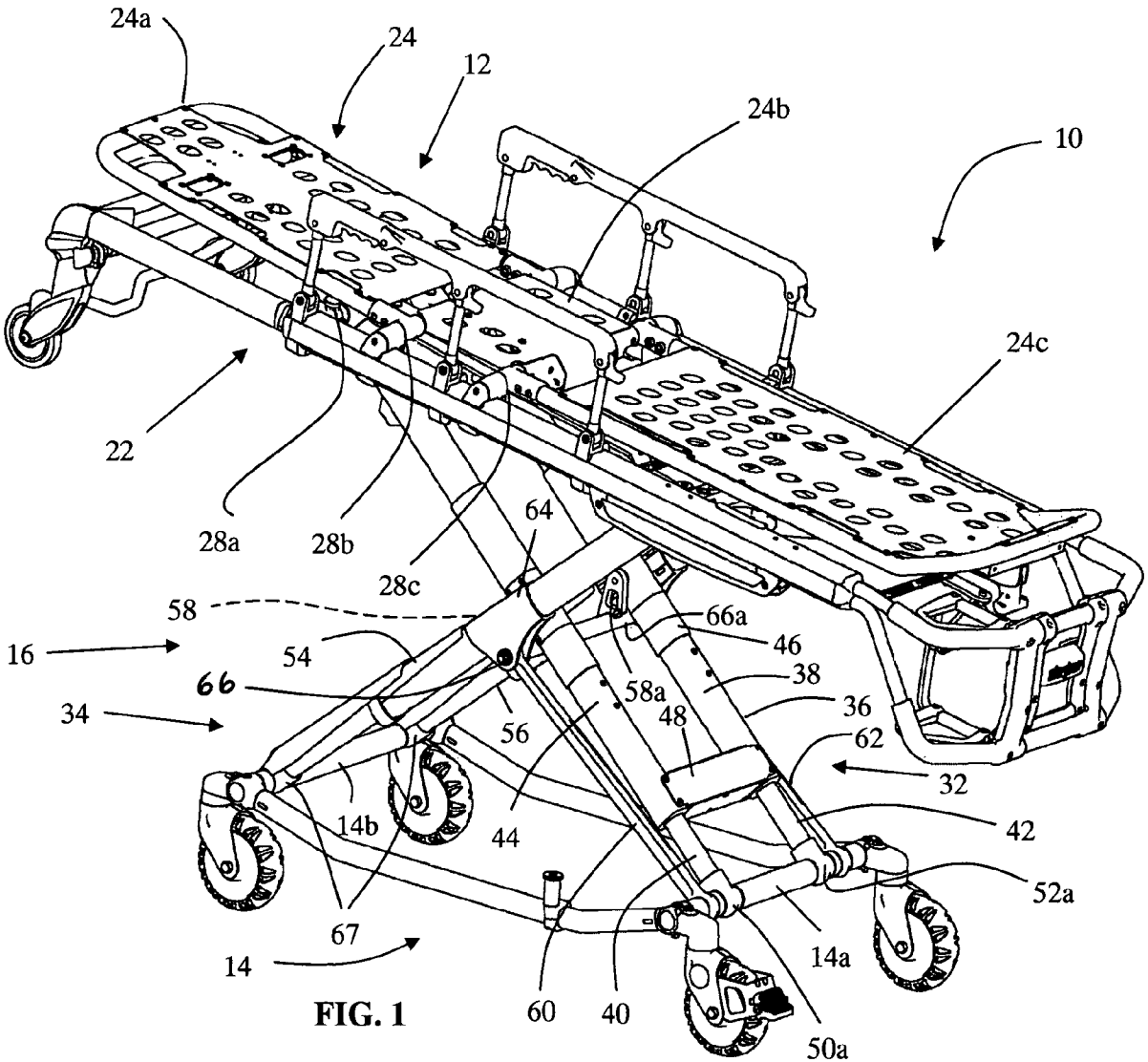
FIG. 1. is a perspective view of the emergency stretcher of the present invention.

Referring to FIG. 1, the numeral 10 generally designates an emergency stretcher or cot of the present invention. Emergency stretcher 10 includes a patient support 12 and a base 14, with a plurality of bearings, such as wheels or castors. Patient support 12 is supported on base 14 by a support frame 16, which is configured to raise or lower the base or patient support relative to the other so that the stretcher can be rearranged between a more compact configuration for loading into an emergency vehicle, such as an ambulance, and a configuration for use in transporting a patient across a ground surface, as will be more fully described below. As will more fully described below in reference to FIGS. 12-15, stretcher 10 may incorporate a mechanical link between the patient support and the base, which reduces, if not, eliminates "base sag".

To lock the vertical height of support frame 16, stretcher 10 incorporates a locking mechanism 18 (FIG. 2), which also may provide a height adjustment function that allows the maximum vertical height of the patient support 12 relative to base 14 to be varied—in other words it may provide an adjustable load height. In addition, locking mechanism 18 may be configured to provide a dampening function so that when support frame 16 is no longer locked in its vertical fixed height configuration by locking mechanism 18, locking mechanism 18 can absorb at least some of the impact that results from the support frame 16 being released from its locked configuration. For example, when the stretcher is pulled out from the back of an ambulance, it is often desirable to let the support frame drop so that the base quickly moves from its compact configuration just beneath the patient support to its ground engaging position so that a single EMT can handle the stretcher. Similarly, an EMT may wish to quickly raise the base, which also can generate an impact force on the stretcher. Further, as noted above and more fully described below in reference to FIG. 11, the locking mechanism may also be configured to provide an adjustable load height.

Figure 2:
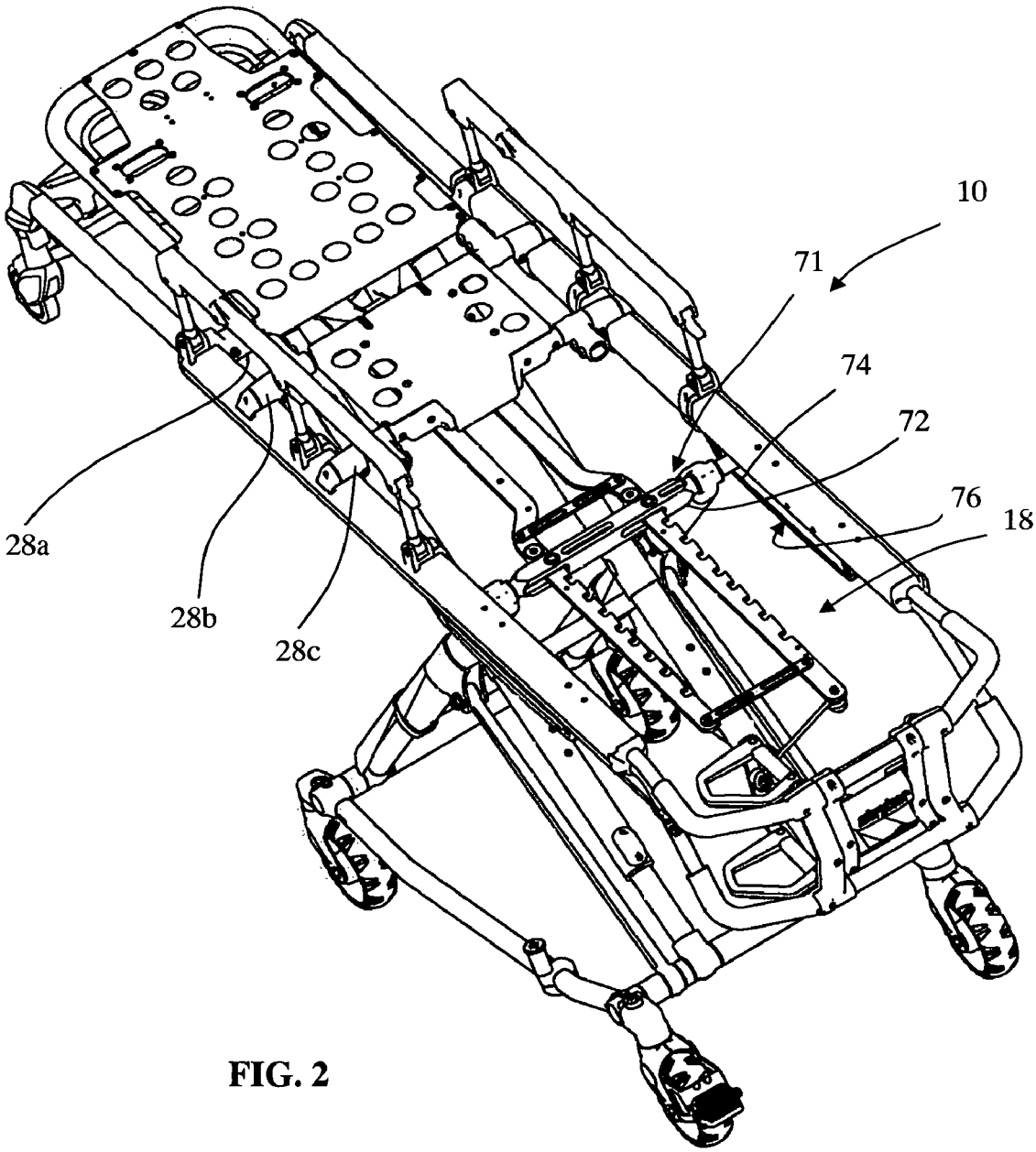
FIG. 2. is another perspective view of the emergency stretcher of FIG. 1 with the litter deck partially removed for clarity.

As best seen in FIGS. 1 and 2, patient support 12, which is commonly referred to as a litter, includes a frame or litter frame 22 and a deck or litter deck 24, which optionally includes a backrest section 24*a*, a seat section 24*b*, and a foot section 24*c*, with sections 24*a* and 24*c* being pivotally mounted to frame 22. Referring again to FIGS. 1 and 2, frame 22 includes a pair of side frame members 26*a* and 26*b*, which are interconnected by cross- or transverse frame members 28*a*, 28*b*, and 28*c*, with cross-frame member 28*a* providing a mounting point for support frame 16, more fully described below. Cross-frame members 28*b* and 28*c* provide support for seat section 24*b* of deck 24, with backrest section 24*a* pivotally mounted about cross-frame member 28*b*, and foot deck section 26*c* pivotally mounted about cross-frame member 28*c*. Further, cross-frame member 28*a* provides a mounting point for locking mechanism 18, also described more fully below. In addition, side frame members 26*a* and 26*b* provide support for collapsible side rails 30*a* and 30*b*. For further details of patient support 12, reference is made to U.S. Pat. No. 5,537,700 and copending published Application No. 2006/0075558, published Apr. 13, 2006, commonly owned by Stryker Corporation, which are herein incorporated by reference in their entireties.

Referring again to FIG. 1, support frame 16 includes a plurality of support members 32 and 34, which are configured to support patient support 12 on base 14 and, further, to provide height adjustment of patient support 12 relative to base 14. Support member 32 comprises an H-shaped frame 36 with a U-shaped frame member 38 and a pair of telescoping frame members 40 and 42, which extend into U-shaped frame member 32 to provide an adjustable length support member. U-shaped member 32 includes a pair of generally parallel frame members 44 and 46, which are interconnected by a transverse or cross-brace member 48. Members 44 and 46 comprise tubular members into which frame members 40 and 42 extend. The distal ends of frame members 40 and 42 are pivotally mounted to base frame member 14*a* of base 14 by a pair of pivot connectors 50*a* and 52*a*, while the upper ends of support member 32 are pivotally mounted to cross-frame member 28*a* by a pair of pivot connectors 50*b* and 52*b*.

Support member 34 may also be adjustable in length and may be formed by a pair of telescoping members 54 and 56, which are pivotally connected to support member 32 at a general medial portion of U-frame member 38 at a pivot axes 58 (FIG. 4) by pivot pins 58*a*. In this manner, support members 32 and 34 form a pair of X-frames, which are interconnected at a point below pivot axis 58 by cross-brace or transverse member 48. As would be understood, in this manner, cross-brace 48 ties the extension and contraction of the respective telescoping frame members 40 and 42 together such that the distances between the respective pivot connectors 50*a*, 50*b* and 52*a*, 52*b* are substantially equal and not independent of each other and, instead, are tied together to thereby increase the stiffness of support frame 16 and, further, of the overall stretcher 10. However, it should be understood that members 54 and 56 may comprise fixed length members, for example such of the type shown in U.S. Pat. No. 6,701,545, which is incorporated herein by reference in its entirety. Consequently, stretcher 10 has an increased base stiffness that reduces side-to-side tilting, which is particularly advantageous when transporting heavier patients.

In addition to support members 32 and 34, support frame 16 includes a pair of linkage members 60 and 62, which are pivotally mounted on one end to transverse member 14*a* of base 14 and on their other ends to the upper end of members 54 and 56. In the illustrated embodiment, linkage members 60 and 62 are pivotally mounted to the upper end of telescoping members 54 and 56 by brackets 64 and a pivot pin or bolt 66, which extends through the brackets and through a tubular member 66*a*, to thereby pivotally mount linkage members 60 and 62 to their respective brackets offset from the pivot axis 58 of the respective support members 32 and 34.

Similar to support member 32, telescoping members 54 and 56 are pivotally mounted on one end to transverse base frame member 14*b* by pivot connectors 67 and, further, mounted to patient support 12 by a common movable pivot connection 71. As best seen in FIG. 2, pivot connection 71 includes a translating transverse member 72, with the upper ends of telescoping members 54 and 56 mounted to transverse member 72 by pivot connectors 73. Opposed ends of translating transverse member 72 are supported in slotted openings 74 of bracket housings 76, which are mounted to and beneath side frame members 26*a* and 26*b*. For further details of how translating transverse member 72 is mounted in bracket housings 76, reference again is made to published copending application Publication No. US 2006/0075558. In this manner, pivot connection 71 allows telescoping members 54 and 56 to pivot about a moving horizontal axis and, further, allow support frame 16 to adjust the height of patient support 12 relative to base 14 and, further, to assume a compact configuration so that stretcher 10 may be loaded into an ambulance, for example.

Figure 3:
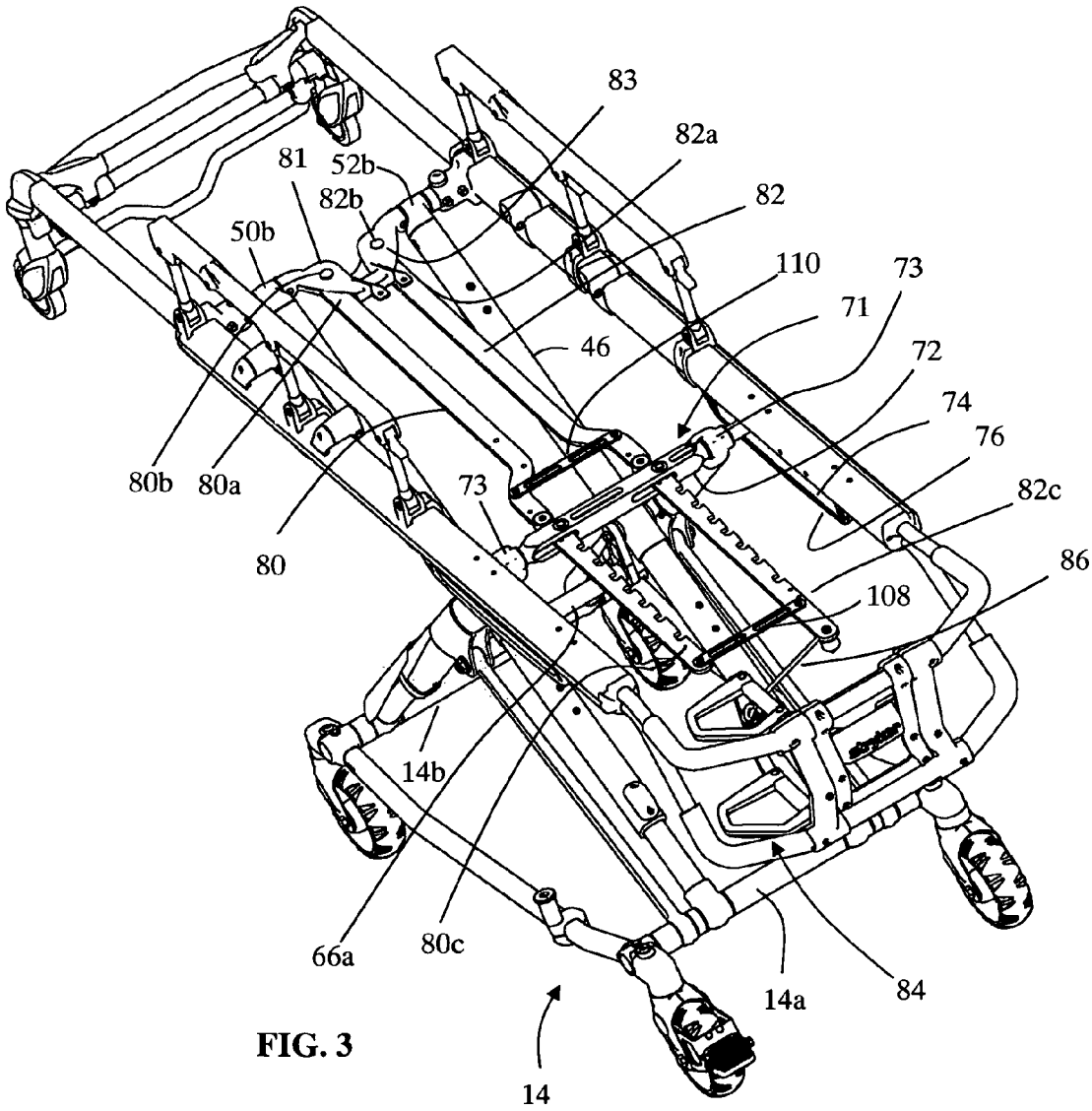
FIG. 3 is a perspective view of the emergency stretcher with the litter deck fully removed to show a locking mechanism.

As noted above, in order to lock the respective lengths of the support members 32 and 34, stretcher 10 incorporates locking mechanism 18. Referring again to FIG. 3, locking mechanism 18 includes a pair of elongate members 80 and 82, which are pivotally mounted at their proximal ends 80*a* and 82*a* about generally vertical axes 80*b* and 82*b* to cross-frame member 28*a* by a pair of brackets 81 and 83. Distal end portions 80*c* and 82*c* of elongate members 80 and 82 are coupled to a handle assembly 84 by a linkage member 86, which moves the elongate members 80 and 82 between a locked position (such as show in FIGS. 5 and 6) and an unlocked position.

Figure 5:
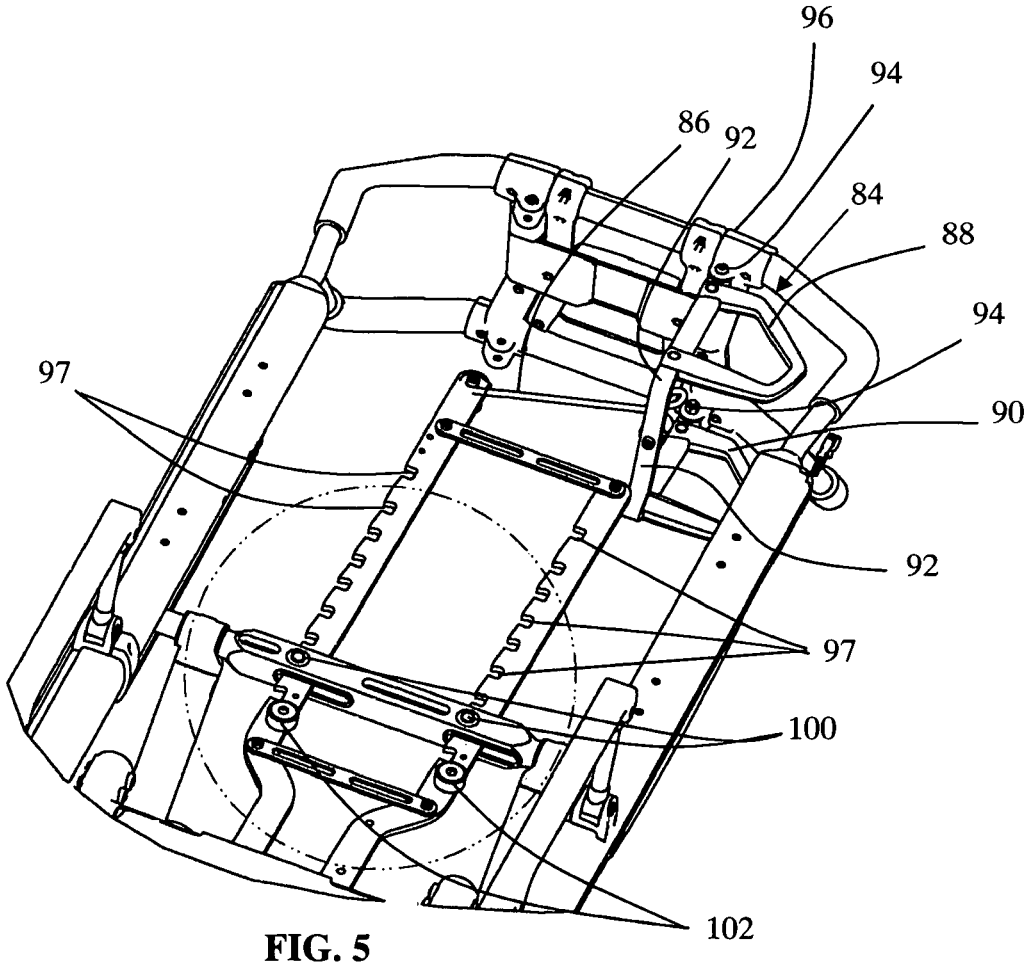
FIG. 5. is an enlarged view of the foot end of the emergency stretcher of FIG. 2 illustrating a locking mechanism that may also provide a height adjustment function.

Handle assembly 84 includes two handles 88 and 90, which are commonly mounted on a C-shaped frame member 92, which is pivotally mounted to litter frame 22 by pivot bolts 94. Bolts 94 are mounted to brackets 96, which are connected to litter frame 22. Optionally, handles 88 and 90 may be spring biased inwardly toward an engaged or locked position, for example by springs located at or near brackets 96, such as shown in FIG. 5, wherein elongate members 80 and 82 are engaged with a respective pair of posts 100 described more fully below. Again, for further details of brackets 96 and litter frame 22, reference is made to the above-referenced patent and published application. In this manner, when either handle 88 or 90 is pulled to the right, for example against the biasing force of the spring, handle assembly 84 will pivot about bolts 94 and linkage member 86 will pull on locking mechanism 18 so that locking mechanism 18 will similarly shift to the right (as viewed in FIG. 7) to thereby disengage from posts 100.

Figure 10:
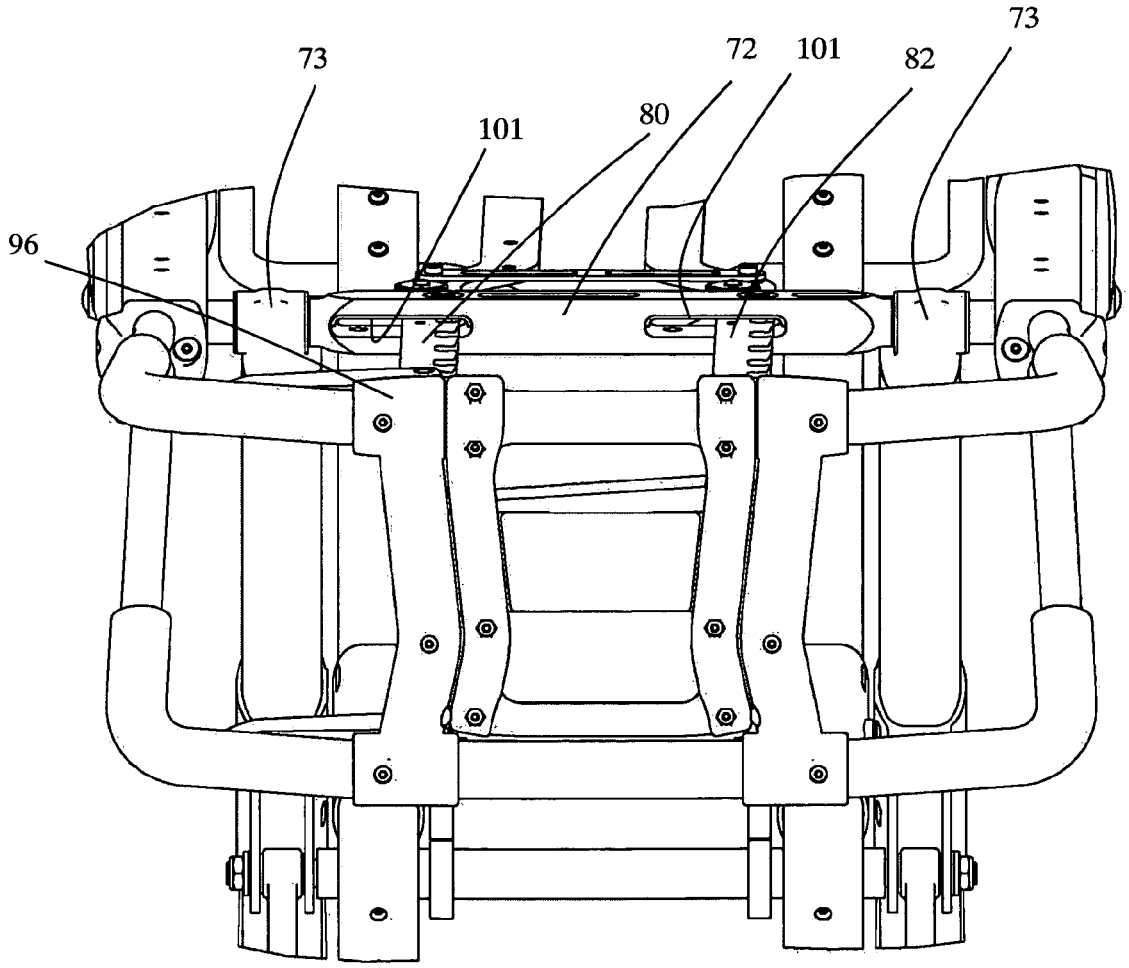
FIG. 10. is an end view of the locking mechanism illustrating the stops engaged by the support frame in its fully extended or maximum vertical height position.

Referring again to FIGS. 5 and 6, each elongate member 80, 82 includes a plurality of notches 97 for engaging translating transverse member 72. As best understood from FIG. 6, transverse member 72 includes a plurality of transverse passages 98 through which elongate members 80 and 82 extend. Located in passageways 98 are posts or pins 100, which extend through transverse member 72 to provide engagement surfaces for engagement by notches 97 of elongate members 80 and 82. Thus when posts 100 are located and fully seated in a pair of notches 97, the longitudinal position of translating transverse member 72 is locked relative to the longitudinal axis of stretcher 10. By providing a plurality of longitudinally spaced notches, therefore, locking mechanism 18 provides a height adjustment function as well as a locking function. Thus when either handle 88, 90 is moved to the right as viewed in FIG. 5, elongate members 80 and 82 are disengaged from posts 100 and moved to an unlocked position to thereby allow translating transverse member 72 to translate along slotted openings 74 of bracket housings 76. Further, to facilitate the movement of translating transverse member 72 along elongate members 80 and 82, passageways 98 optionally incorporate bearings 101 (FIG. 10).

When support frame 16 has reached a desired height, handles 88 or 90, which as noted may be spring biased inwardly toward the stretcher, may then be released or pushed so that elongate members 80 and 82 pivot about their respective proximal ends 80*a* and 82*a* to engage posts 100 with another set of notches 97 to thereby fix the height of the stretcher. As will be understood, when translating transverse member 72 is fixed in position longitudinally with respect to the stretcher, the height of stretcher 10 is fixed. Therefore, when the stretcher is removed from an emergency vehicle and the hot-drop function is desired, the user may simply pull on one of the handles 88, 90 to release the locking mechanism from engagement with posts 100 and allow translating transverse member 72 to translate along slotted openings 74.

Figure 8:
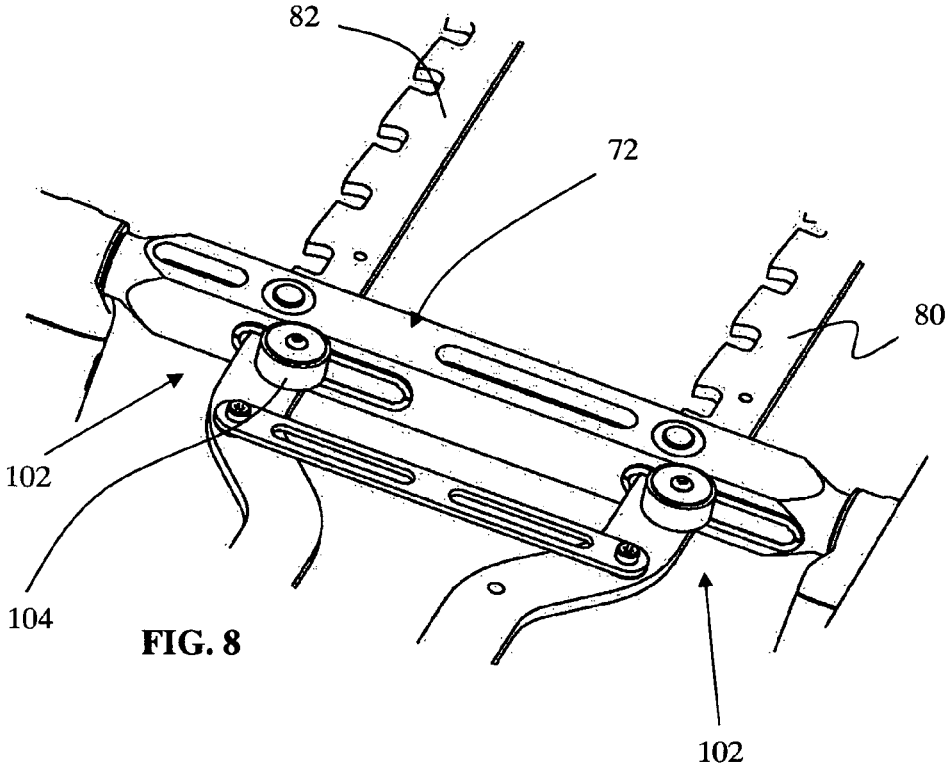
FIG. 8 is a similar view to FIG. 6 illustrating the stops engaged by the support frame in its fully extended position.
Figure 7:
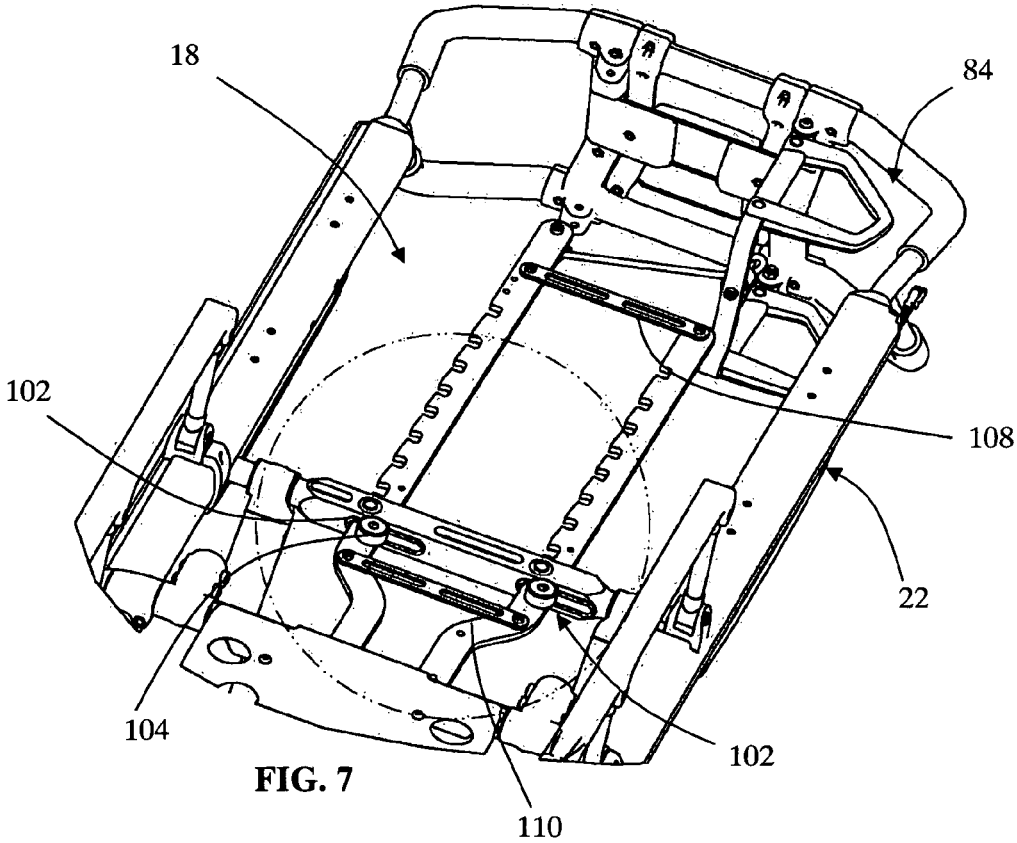
FIG. 7. is an enlarged plan view of a portion of the locking mechanism illustrating the stops of the locking mechanism in a first position.

To reduce the impact on the various components on stretcher 10, as noted above, locking mechanism 18 is adapted to absorb at least some of the impact energy when support frame 16 is released from engagement with the locking mechanism and drops base 14 to the ground, for example. In addition, locking mechanism 18 may be adapted to absorb energy when the support frame is lifted up to its compact configuration, which may also induce impact loads on the stretcher structure. Referring to FIGS. 7 and 8, when base 14 is allowed to drop and support frame 16 allowed to extend to its fully extended position, translating transverse member 72 will move downward as viewed in FIG. 7 and will engage stops 102. In the illustrated embodiment, stops 102 are mounted on locking mechanism 18. Stops 102, therefore, transfer at least some of the impact forces to elongate members 80 and 82. Because of their length and slender construction (high slenderness ratio), members 80 and 82 will deflect under the impact load and in effect act like a pair of springs to thereby absorb at least some of the energy when the locking mechanism is in its unlocked position and the support members engage the stops. Furthermore, stops 102 optionally comprise bumpers 104 formed from an energy absorbing material, such as a plastic material, including an engineered plastic, such as isobutyl rubber, which will also absorb some of the impact load due to the hot-drop function of the structure.

Figure 9:
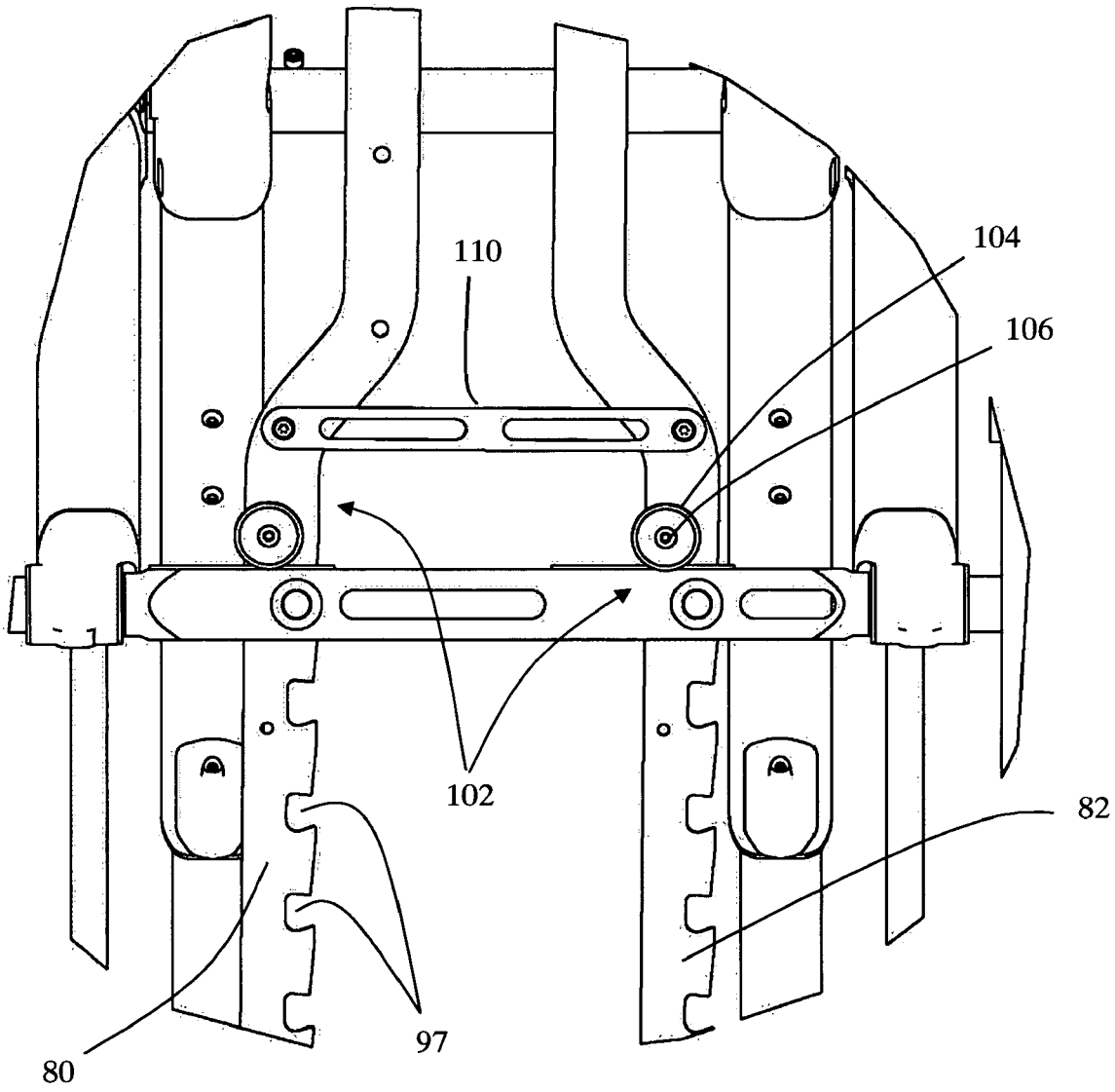
FIG. 9. is an enlarged plan view of a portion of the locking mechanism of FIG. 8.
Figure 11:
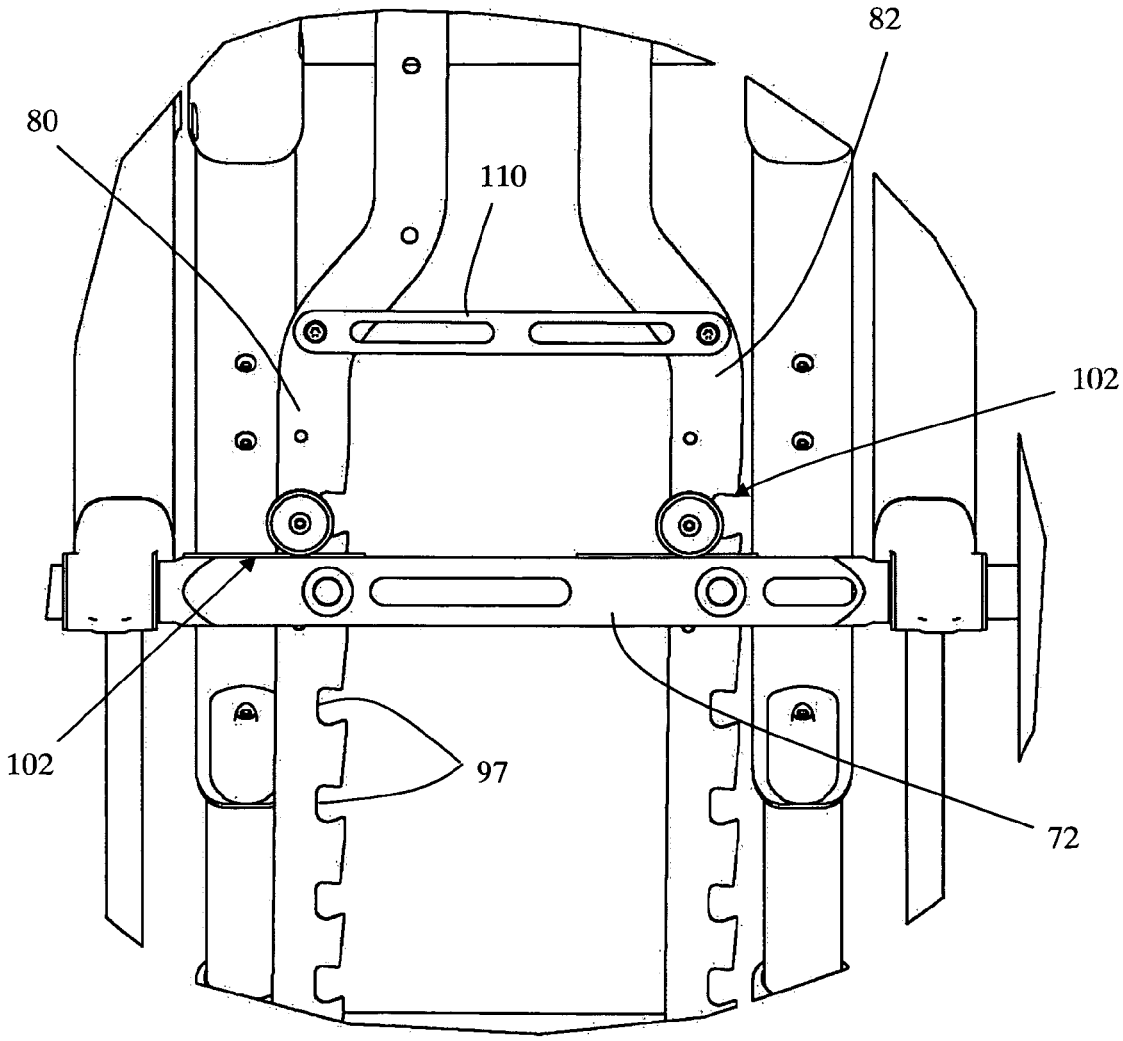
FIG. 11. is a similar view to FIG. 9 illustrating the stops moved to a second position to adjust the height of the load emergency stretcher.
Figure 12:
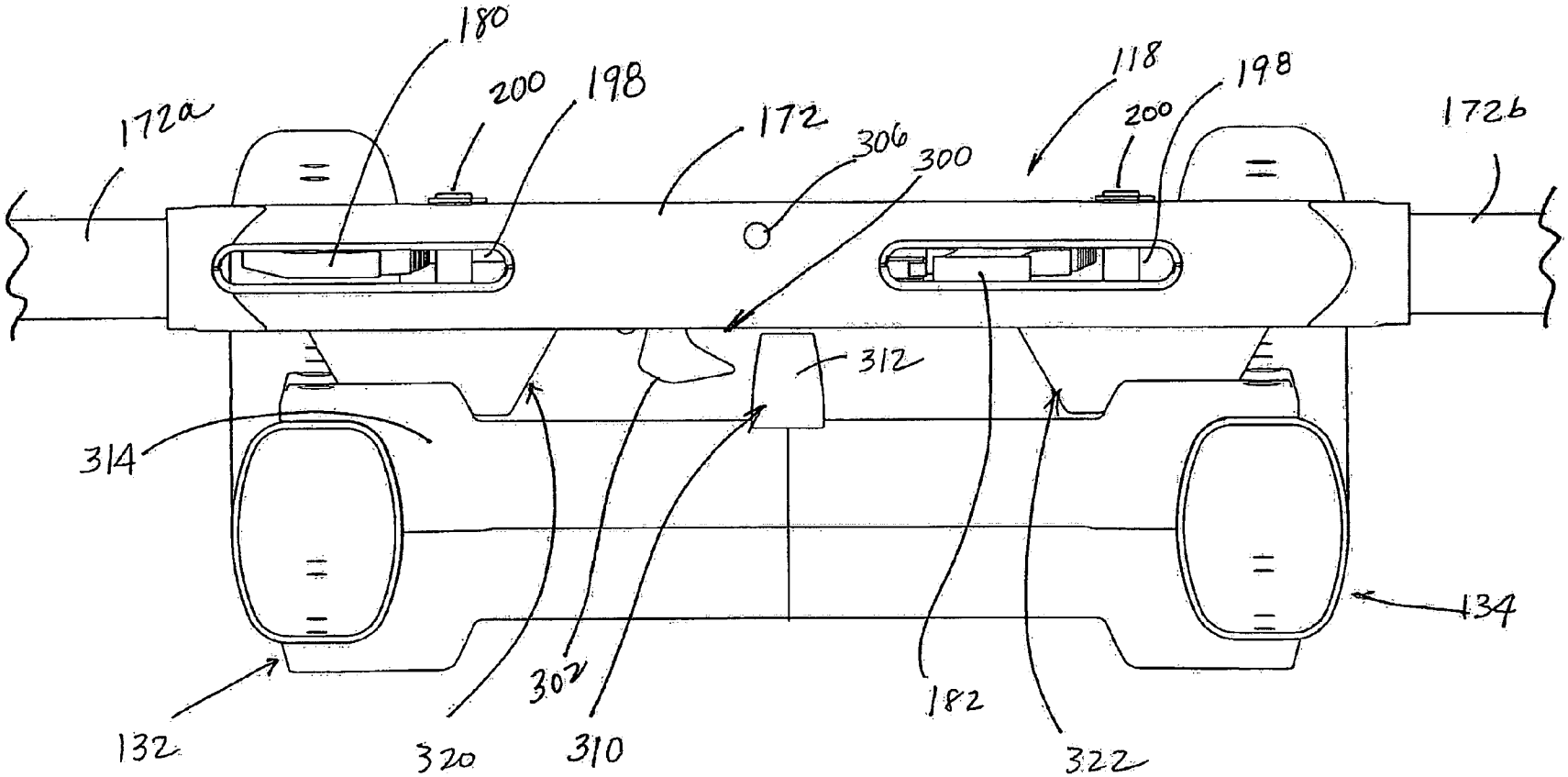
FIG. 12 is a fragmentary elevation view of the translating transverse member of the locking mechanism illustrating a further embodiment of the locking mechanism incorporating a locking hook illustrated in an unlocked position.

As best seen in FIGS. 8 and 9, bumpers 104 are mounted to the respective elongate members 80 and 82 by pins 106, which extend through mounting openings provided in members 80 an 82. Pins 106 may be secured in place by nuts or other fasteners to allow the pins to be manually removed so that the bumpers can be removed. Further, as best seen in FIG. 11, elongate members 80 and 82 may include a plurality of mounting openings to allow the bumpers to be moved and relocated at a different stop position along the length of the elongate members to adjust the maximum height of the stretcher to accommodate variation in the load height of ambulance load decks. For example, when an emergency department purchases an emergency stretcher, the stretcher may have a longer life expectancy than the emergency vehicle. Therefore, even if the stretcher is initially purchased with a load height that is suited to their present needs, the manually removable and adjustable bumpers would allow the emergency department to move the bumpers to accommodate newer or different vehicles with various load heights. For example, the load height currently can vary from about 28 inches to about 36 inches between vehicles. Additionally, mass casualty situations may require ambulance cots to be used in different vehicles to properly manage the situation (i.e. cot A normally associated with vehicle A goes into vehicle B, and cot B normally associated with vehicle B goes into vehicle C).

Figure 4:
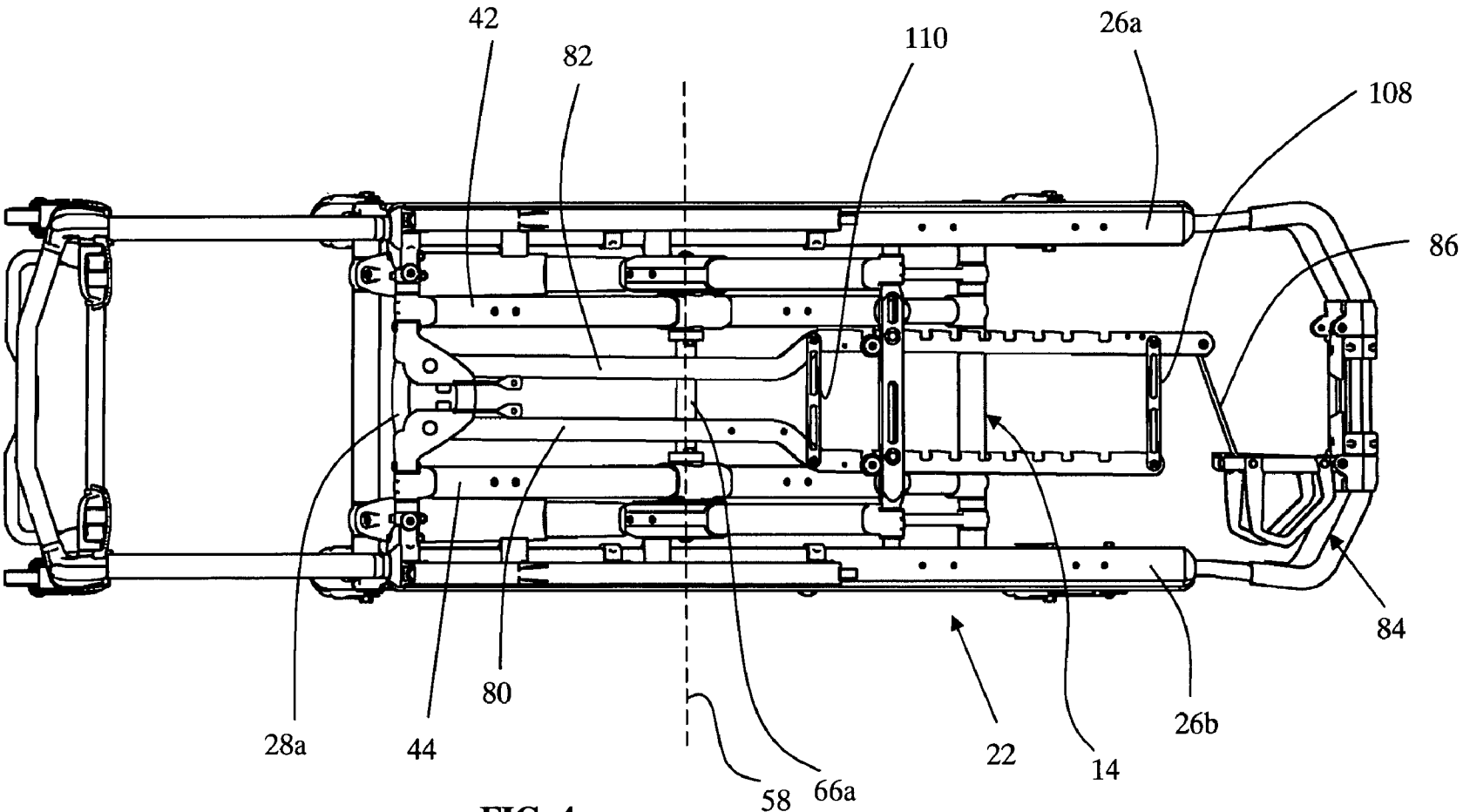
FIG. 4 is a top plan view of the emergency stretcher with the litter deck removed.
Figure 6:
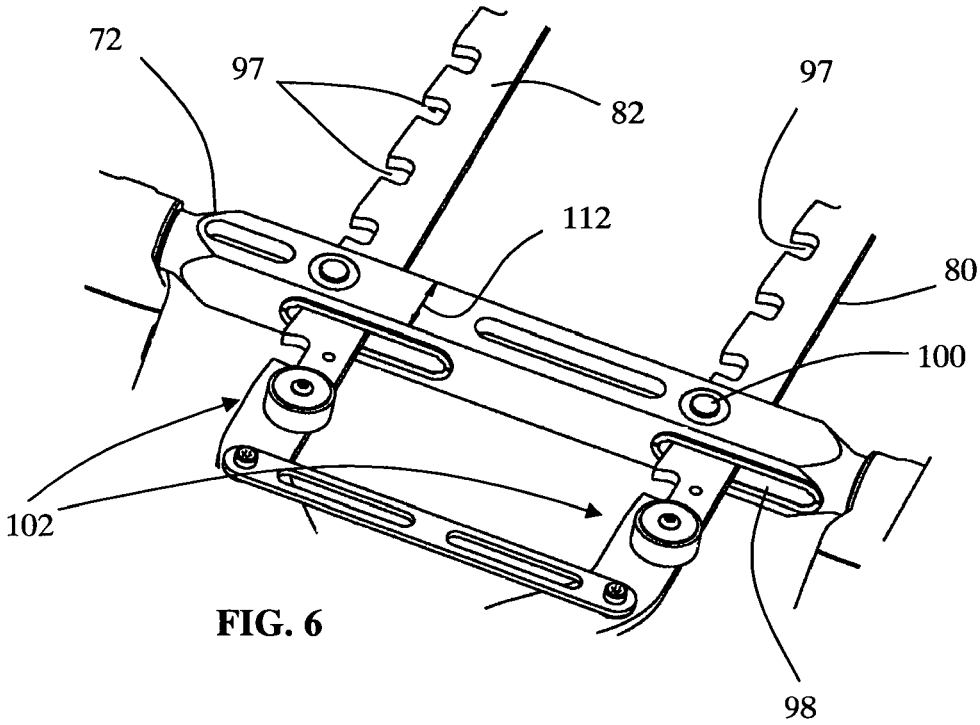
FIG. 6. is an enlarged view of the mounting arrangements of the locking mechanism of FIG. 5.

Referring again to FIGS. 3 and 5, in order to maintain elongate members 80 and 82 generally parallel and further to move both elongate members in unison, elongate members 80 and 82 are interconnected by a pair of transverse brace members 108 and 110, which maintain elongate members 80 and 82 in a generally parallel and rectangular arrangement, as best understood from FIGS. 3-6. Referring again to FIG. 6, transverse passageways 98 each have a transverse extent 112, which results in sufficient bearing contact with elongate members 80 and 82 to provide limited torsional resistance to member 72, which may further improve the stiffness of stretcher 10.

Referring to FIGS. 12-15, as noted above, stretcher 10 may optionally incorporate a lockable link 300 between the patient support 12 and a fixed or fixable point at the base 14, which provides a relatively rigid mechanical link or coupling between the patient support and the base to increase the stiffness and reduce, if not, remove the "base sag" of stretcher 10 when the base is raised to the patient support to its folded or collapsed position. This "base sag" can cause issues when loading the cot into the patient compartment in the rear of the ambulance. For example, when the base sags, the caster wheels may contact the rear opening of the ambulance, which would then require the EMT/caregiver to raise the cot even higher. Further, with this additional coupling, the tendency of the stretcher to "accordion" open, for example, when in a collision is reduced, if not eliminated, such that in this regard the cot and cot fastening system tends to exhibit improved crashworthiness.

In the illustrated embodiment, lockable link 300 is incorporated into the locking mechanism (118) that locks the height of patient support 12 relative to base 14. Locking mechanism 118 is of similar construction to locking mechanism 18 described above, with the modifications noted below. As best seen in FIGS. 12-15, lockable link 300 is mounted in translating transverse member 172 of locking mechanism 118, which is of similar construction to transverse member 72 of the locking mechanism 18 of the first embodiment. Similar to transverse member 72, transverse member 172 supports a pair of elongate members 180 and 182, with each elongate member 180, 182 including a plurality of notches 197 formed in their respective sides for engaging posts 200 supported in transverse member 172, which provide a plurality of locked positions for the patient support relative to the base. For further details of and the operation of the elongate members 180 and 182, posts 200, and their respective mounting arrangements and the optional dampening features, reference is made to the first embodiment.

Referring again to FIG. 13, lockable link 300 is provided by a pivotal member, such as a pivotal hook or hook member 302, which is mounted in transverse member 172 and, further, mounted in a recess 304 formed at the underside of transverse member 172. Hook member 302 is mounted on a rotatable shaft 306, which is supported in recess 304, and is biased toward a locked position (as best seen in FIG. 15) by a biasing member, such as a spring 308, which is also supported in recess 304.

In its locked position, locking hook 302 engages an engagement structure 310 provided within or on base 114. In the illustrated embodiment, engagement surface 310 is provided by a loop or loop member 312 with a transverse recess, which is rigidly mounted to a transverse member 314 that extends and is mounted between the support members 132 and 134. Transverse member 314 thus provides increased stiffness to the legs, similar to transverse member 48. Further, when the legs are in their lowered position, transverse member 314 is forward of the rear base frame member of the base (which rear base frame member is identified by the numeral 14*a* in the first embodiment) but positioned in close proximity to the rearward base frame member and in close proximity to the rear casters. Further, when support members 132 and 134 are fully compressed and collapsed such that the patient support is closely adjacent the base, transverse member 314 will generally lie in the same plane as the base frame members of the base. For further details of the base and the support members, reference is made to base 14 and support members 32 and 34 of the first embodiment.

Transverse member 314 is mounted to the respective support members 132 and 134 at a location such that when the patient support is in its fully lowered position the loop member 312 will be located beneath transverse member 172. Further, loop member 312 will be oriented to align with hook 302 to allow hook 302 to extend into the transverse recess 312*a* that extends through loop 312 to thereby engage loop 312 and form a mechanical link between the patient support and a fixed or fixable point at the base. In this manner, when the base is raised relative to the patient support or the patient support is lowered to its lowermost position adjacent the base, the stretcher will exhibit reduced lateral and longitudinal play, which typically result from the various linkages provided by the support members 132 and 134 between the base and the support and which inherently have some amount of play to avoid binding. Consequently, the stretcher will not exhibit "base sag" and instead will be releasably locked in its compact, folded configuration.

Figure 13:
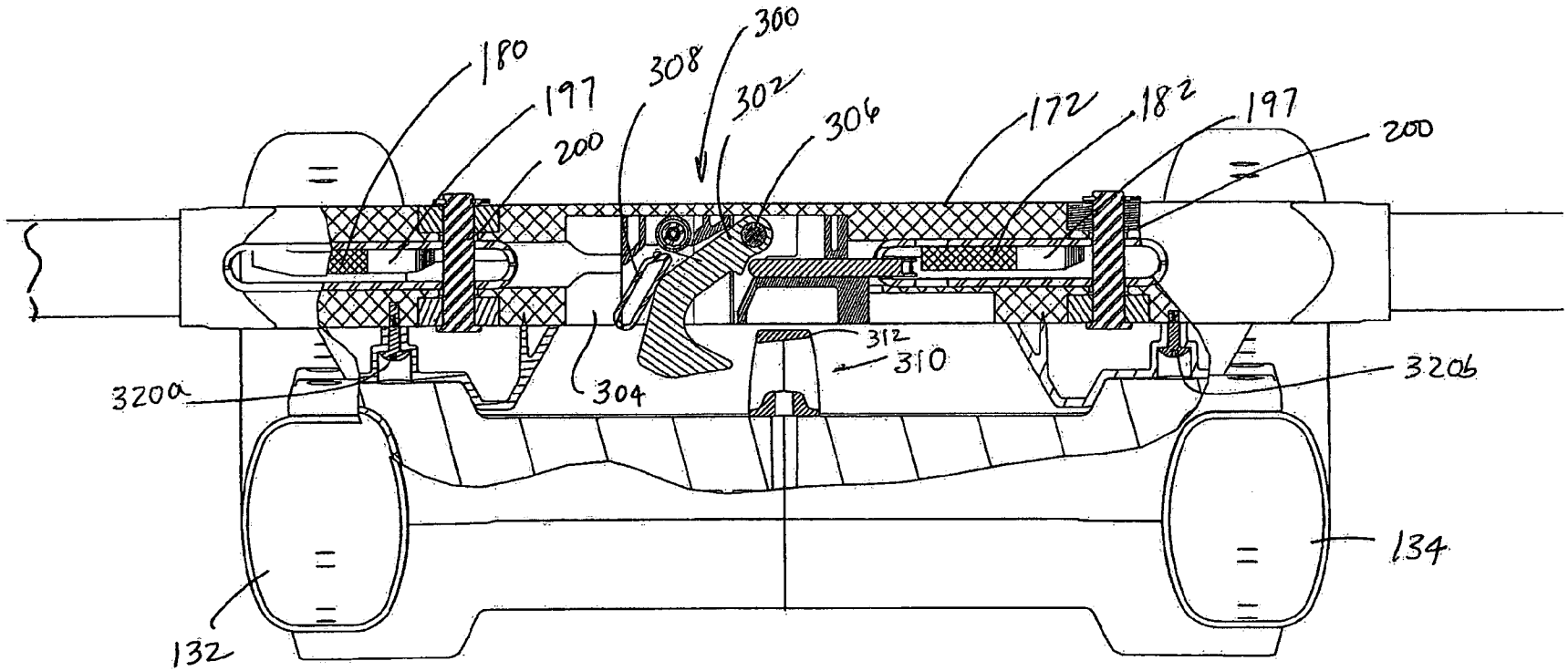
FIG. 13 is a partial cross-section view of FIG. 12 taken through the transverse member of the locking mechanism.
Figure 14:
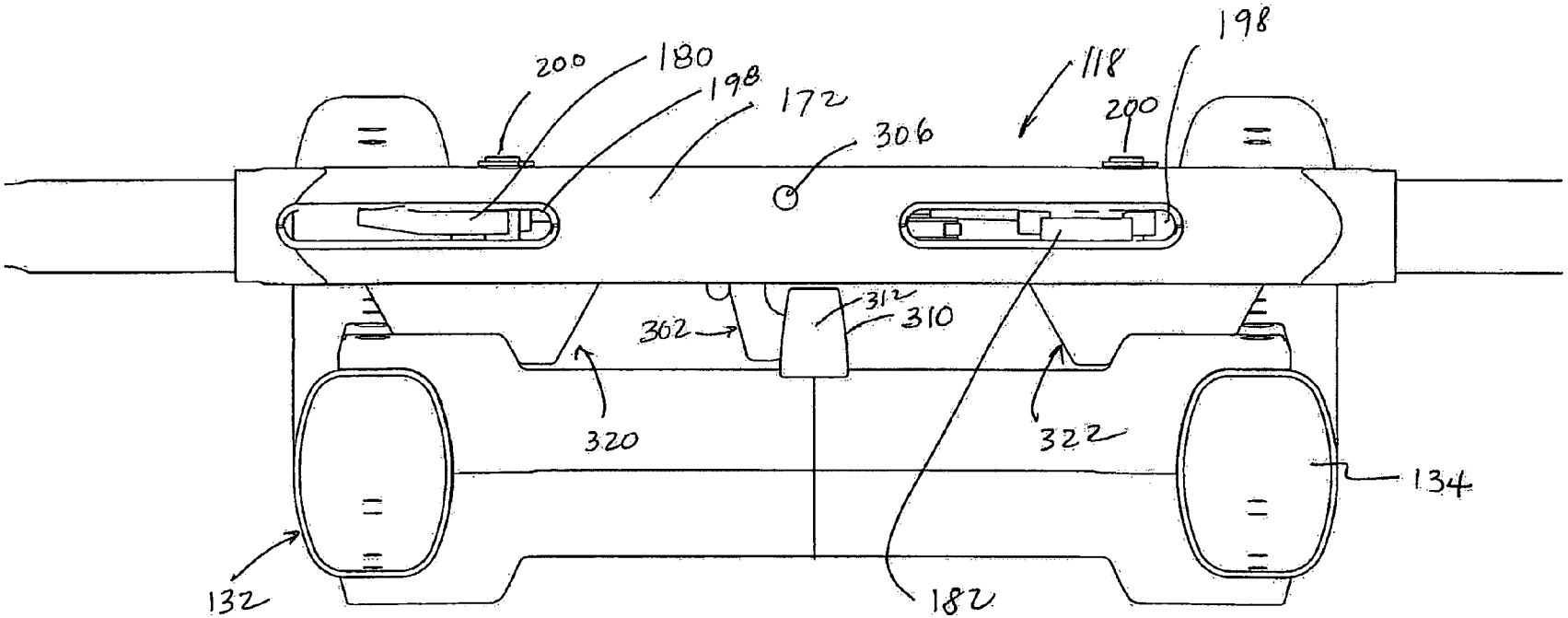
FIG. 14 is a similar view to FIG. 12 illustrating the locking hook moved to its locked position.
Figure 15:
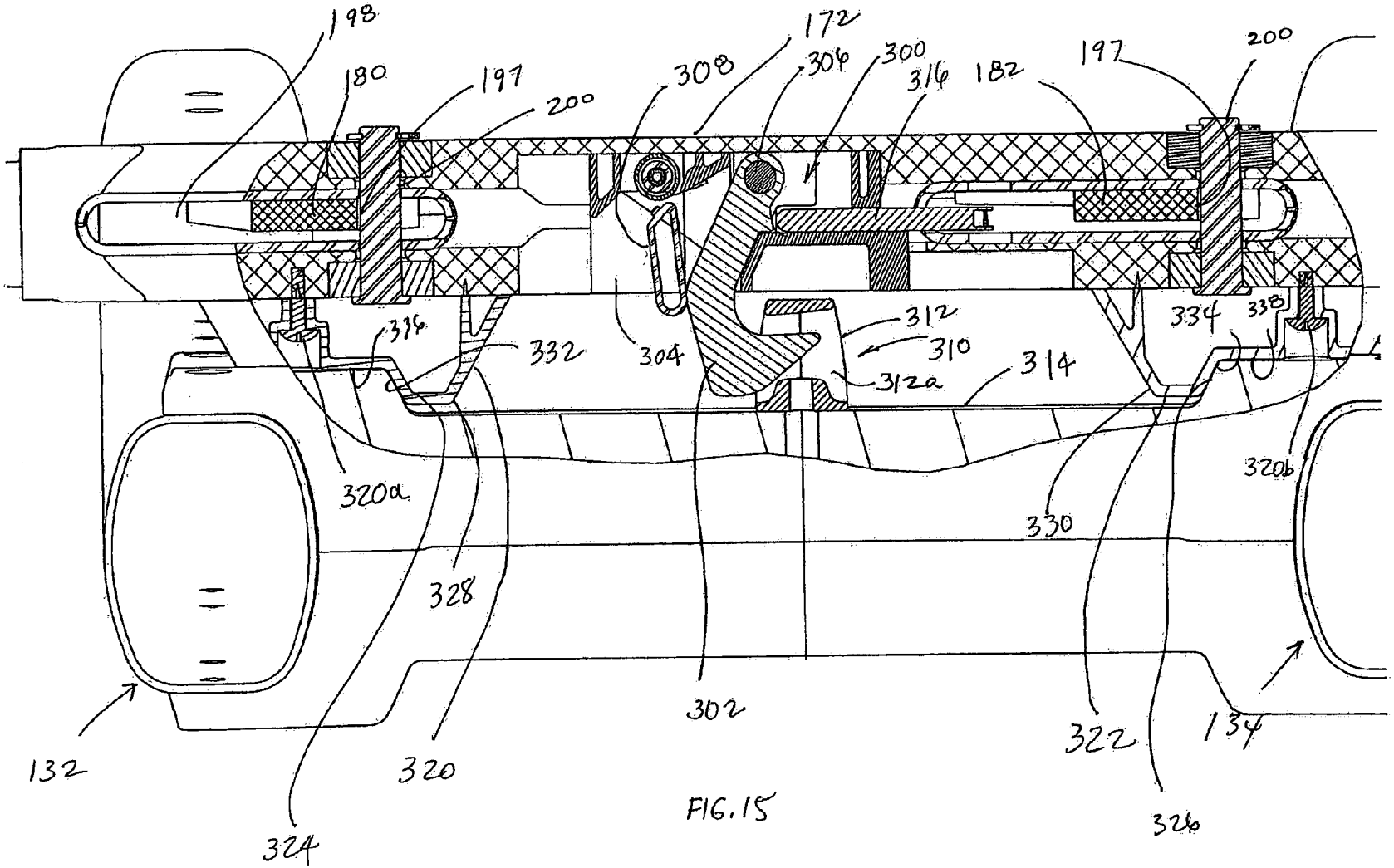
FIG. 15 is a partial cross-section view taken through the transverse member of FIG. 14.

As best understood from FIGS. 13 and 15, elongate members 180 and 182 are adapted to disengage locking hook 302 from its locked position when they are respectively moved from their locked positions to their unlocked positions, such as shown in FIG. 13. Referring to FIGS. 13 and 14, elongate member 182 includes a transverse pin 312, which forms a laterally extending trigger 316 and which pivots locking hook 302 in a counterclockwise direction as viewed from FIG. 15 against the force of spring 308 to thereby disengage locking hook member 302 from loop member 312. In the illustrated embodiment, pin 316 is mounted to elongate member 182 by a fastener. However, it should be understood that the pin or other similar structure may be integrally formed, including such as by welding, with elongate member 182. In this manner, elongate member 182 is coupled to the hook member 302 only over a limited range of motion. Thus, when the stretcher is collapsed into a folded configuration, hook 302 provides an automatic mechanical linking between the patient support and a point within the base of the stretcher. Further, because the mechanical linking is coupled to the locking and unlocking mechanism of the stretcher's adjustable length support members, the mechanical linking is automatically released when the stretcher's adjustable length support members are released.

In the illustrated embodiment, spring 308 comprises a generally hollow elastomeric member in the form of a torsion spring, which is positioned adjacent pivoting hook 302 and positioned to urge hook 302 to its locked position as shown in FIG. 15. However, it should be understood that other springs may be used. For example, shaft 306 may include a coil spring that urges shaft 306 and in turn hook member 302 to its locked position. Alternately, hook member 302 may be mechanically linked to elongate member 182.

Referring again to FIGS. 13 and 15, in addition to the automatic mechanical link provided between the patient support and the fixable point at or within the base, which provides both a vertical restraint and a longitudinal restraint, the stretcher may also incorporate a cooperative surface or surfaces between the patient support and the base, which provide additional lateral stability to the stretcher when the stretcher is in its collapsed or folded configuration. In the illustrated embodiment, these cooperative surfaces are provided by elongate block members 320 and 322 that are mounted to the underside of transverse member 172 by fasteners 320*a* and 320*b*. Alternately, members 320 and 322 may be integrally formed with transverse member 172. Members 320 and 322 cooperate with angled surfaces 324 and 326 provided on transverse member 314 and have each a corresponding angled surface 332 and 334, which rest on the respective angled surfaces 324 and 326 of transverse member 314 when the patient support is lowered to its collapsed position, adjacent the base. The angled surfaces, therefore, provide a lateral restraint for transverse member 172 at transverse member 314, which in turn provides additional lateral restraint between the patient support and the base. Members 320 and 322 and transverse member 314 may be made from any suitable rigid material including metal, plastic, or a combination thereof and may be formed from an elastomeric material, such as rubber, to reduce the noise when the stretcher is moved to its collapsed position and, further, to provide additional dampening between the patient support and the base.

In the illustrated embodiment, members 320 and 322 comprise hollow elongated block members, with downwardly depending portions 328 and 330. Downwardly depending portions 328 and 330 extend downward from bearing surfaces 336 and 338 to define the angled surfaces 332 and 334, which generally mate with the angled surfaces 324 and 326 of transverse member 314. In this manner, as best understood from FIG. 15, when locking hook member 302 is in its locked position, locking hook 302 and members 320 and 322 provide resistive forces in the lateral, longitudinal, and vertical directions. Additionally, therefore, members 320 and 322 may form internal stops for the patient support when lowered relative to the base. Consequently, the rigidity of the stretcher is significantly enhanced when in its collapsed locked position.

Accordingly, the present invention provides a stretcher that incorporates a mechanical link between the patient support and the base to reduce base sag and to ease loading and unloading and improve retention in a cot fastening system in the event of a crash. The stretcher may also incorporate a dampening system that reduces the impact on some components of the stretcher associated with a hot-drop function. Furthermore, the support frame of the present invention may be configured to provide an increased stiffness, which provides enhanced stability to the patient support, which may improve the patient's sense of security, especially for bariatric patients. Further, the present invention provides a stretcher that may incorporate an adjustable load height. Furthermore, while a stretcher incorporating all these features is illustrated and described, the stretcher of the present invention may incorporate any one of these features alone or in combination with any one or all the other features.

While several forms of the invention have been shown and described, other forms will now be apparent to those skilled in the art. For example, while illustrated as mechanical stops, the stops may comprise non-contact stops or bumpers, such as a magnetic field that is generated, for example by an electromagnet and when actuated creates a magnetic coupling that stops the movement, for example of the translating traverse member 72. Further, the stops may be provided on the translating member 72, which stops then make contact with, for example, the elongate members of the locking mechanism. In addition, one or more of the features of the stretcher of the present invention may be incorporated into other stretchers. Similarly, other features from other stretchers may be incorporated into the stretcher of the present invention. Examples of other stretchers that may incorporate one or more of the features described herein or which have features that may be incorporated herein are described in U.S. Pat. Nos. 7,100,224; 5,537,700; 6,701,545; 6,526,611; 6,389,623; and 4,767,148, and U.S. Publication Nos. 2005/0241063 and 2006/0075558, which are all incorporated by reference herein in their entireties.

Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which an exclusive property right or privilege is claimed are defined as follows:

1. A stretcher comprising:

a patient support;

a base;

a plurality of support members supporting said patient support relative to said base, said support members being adapted and arranged to raise or lower said base relative to said patient support;

a releasable locking link between said patient support and a point at said base, said releasable locking link movable between an unlocked position and a locked position wherein said patient support is restrained relative to said base when said patient support is lowered to said base and said locking link is moved to its locked position wherein said locking linking link comprises a pivotal locking member, said pivotal locking member forming said lockable link, and said point comprising an engagement surface, with said pivotal locking member selectively engaging said engagement surface to thereby lock said patient support at said base; and a biasing member to urge said pivotal locking member to said locked position.

2. The stretcher according to claim 1, wherein said pivotal locking member comprises a pivotal hook.

3. A stretcher comprising;

a patient support:

a base;

a plurality of support members supporting said patient support relative to said base, said support members being adapted and arranged to raise or lower said base relative to said patient support;

a releasable locking link between said patient support and a point at said base, said releasable locking link movable between an unlocked position and a locked position wherein said patient support is restrained relative to said base when said patient support is lowered to said base and said locking link is moved to its locked position; and a locking mechanism, said support members having movable pivot connections at said patient support and pivot connections at said base, said locking mechanism releasably locking the longitudinal positions of said movable pivot connections of said support members relative to said patient support to thereby lock the height of the patient support, and said locking mechanism including said releasable locking link.

4. The stretcher according to claim 3, wherein said locking mechanism includes a pair of elongate members pivotally mounted at one end to said patient support and movable at their opposed ends between a first position wherein said elongate members lock the position of the movable pivot connections of the support members and a second position when the movable pivot connections of the support members are released from said locked position, said locking link being coupled to one of said elongate members.

5. The stretcher according to claim 3, wherein said locking linking link comprises a pivotal locking member, said pivotal locking member forming said lockable link.

6. The stretcher according to claim 5, wherein said point comprises an engagement surface, and said pivotal locking member selectively engaging said engagement surface to thereby lock said patient support at said base.

7. The stretcher according to claim 3, further comprising a biasing member to urge said locking link to said locked position.

8. A stretcher comprising:

a patient support;

a base;

a plurality of support members supporting said patient support relative to said base, said support members being adapted and arranged to raise or lower said base relative to said patient support; and a releasable locking link between said patient support and a point at said base, said releasable locking link movable between an unlocked position and a locked position wherein said patient support is restrained relative to said base when said patient support is lowered to said base and said locking link is moved to its locked position, wherein said locking linking link comprises a pivotal locking member, said pivotal locking member forming said lockable link, and said point comprising an engagement surface, with said pivotal locking member selectively engaging said engagement surface to thereby lock said patient support at said base, and said engagement surface being formed by a loop, said pivotal locking member extendable into said loop and thereby locking said patient support at said base.

9. The stretcher according to claim 8, wherein said engagement surface is provided at a generally medially location in said base when said patient support is lowered to said base.

10. The stretcher according to claim 9, wherein said engagement surface is supported by said support members.

11. A stretcher comprising:

a patient support;

a base;

a plurality of support members supporting said patient support relative to said base, each of said support members comprising a variable length support member and being adapted and arranged to raise or lower one of said base and said patient support relative to the other of said base and said patient support; and a locking mechanism for locking said variable length support members to thereby lock the height of the patient support relative to said base, and said locking mechanism including a lockable mechanical link for selectively locking said patient support at said base when said patient support is lowered to said base or when said base is raised to said patient support.

12. The stretcher according to claim 11, wherein said lockable link comprises a pivotal hook supported by said patient support and movable between an unlocked position and a locked position.

13. The stretcher according to claim 12, further comprising a loop at said base with a transverse recess, said hook extendable into said loop when said pivotal hook is moved to its locked position.

14. The stretcher according to claim 12, wherein said locking mechanism comprises a pair of elongate members movable between a first position wherein said elongate members lock the length of the support members and a second position wherein the support members are released to lower or raise said base relative to said patient support surface, and said lockable link actuated to move from its locked position to its unlocked position by one of said elongate members.

15. The stretcher according to claim 14, wherein said loop is supported by two of said support members.

16. The stretcher according to claim 15, wherein said two support members are interconnected by a transverse member, said loop mounted to said transverse member.

17. The stretcher according to claim 14, wherein said elongate members define a plurality of locked positions.

18. A method of enhancing the stiffness of a stretcher when the stretcher is collapsed into a folded configuration, the stretcher having a patient support, a base, a plurality of adjustable length support members supporting the patient support relative to the base, the support members being adapted and arranged to raise or lower the base or the patient support between a raised configuration wherein the base and the patient support are adjacent each other and in a compact configuration and a lowered configuration wherein the base support is lowered and spaced from the patient support, said method comprising:

providing a lockable link between said patient support and said base; and actuating the lockable link mechanically link to the patient support at the base to thereby lock the patient support in position at the base when the base is in its raised position adjacent the patient support to thereby prevent the base from lowering relative to said patient support; and disengaging the lockable link when the base is lowered relative to the patient support or the patient support is raised relative to the base.

19. The method according to claim 18, automatically mechanically locking the patient support in its locked position when the base is moved to its raised position.

20. The method according to claim 19, further comprising selectively locking or unlocking the length of the adjustable support members to thereby adjust the height of the patient support relative to the base.

21. The method according to claim 20, further comprising mechanically coupling said disengaging to the unlocking of the stretcher's telescoping support members wherein the mechanical linking is released automatically when the length of the stretcher's telescoping support members are unlocked.

* * * * *